US007665451B2

(12) United States Patent
Lam

(10) Patent No.: US 7,665,451 B2
(45) Date of Patent: Feb. 23, 2010

(54) IGNITION APPARATUS

(76) Inventor: Joe Luk Mui Lam, Apt Blk 809, Woodlands Street 81, Singapore (SG) 730809

( * ) Notice: Subject to any disclaimer, the term of this patent is extended or adjusted under 35 U.S.C. 154(b) by 0 days.

(21) Appl. No.: 11/568,297

(22) PCT Filed: Apr. 4, 2005

(86) PCT No.: PCT/SG2005/000114

§ 371 (c)(1),
(2), (4) Date: Oct. 25, 2006

(87) PCT Pub. No.: WO2006/107272

PCT Pub. Date: Oct. 12, 2006

(65) Prior Publication Data

US 2007/0235012 A1 Oct. 11, 2007

(51) Int. Cl.
*F02P 3/06* (2006.01)

(52) U.S. Cl. ..... 123/604; 174/120 R; 174/121 R; 123/606

(58) Field of Classification Search ..... 315/85, 315/58, 71; 313/134; 338/214, 66, 334; 174/110 S, 120 SC, 127, 120 R, 121 R, 107–109, 174/105 SC; 252/511; 524/37, 43, 46, 562; 123/633, 604; 363/21, 86; 361/257; 156/51–56
See application file for complete search history.

(56) References Cited

U.S. PATENT DOCUMENTS 2,896,120 A * 7/1959 Spittler ..... 315/85
3,582,534 A * 6/1971 Anderson ..... 174/73.1
3,680,027 A * 7/1972 Vitale ..... 338/214
3,680,029 A * 7/1972 Berry ..... 338/334
4,090,984 A * 5/1978 Lin et al. ..... 252/511
4,431,982 A 2/1984 Monroe et al.
4,435,692 A 3/1984 Miyamoto et al.

(Continued)

FOREIGN PATENT DOCUMENTS

CS 272620 5/1990

(Continued)

OTHER PUBLICATIONS

International Search Report for International Application No. PCT/SG2005/000114 dated Mar. 22, 2006.

*Primary Examiner*—Stephen K Cronin
*Assistant Examiner*—Keith Coleman
(74) *Attorney, Agent, or Firm*—Hamre, Schumann, Mueller & Larson, P.C.

(57) ABSTRACT

Ignition apparatus 10 includes high tension ignition cable 56. The cable 56 is of low electrical resistance per unit length. A central core 100 of the cable 56 is formed of carbon fiber filaments. An insulating layer 110 is provided around the core 100. A semiconductor layer 120 is provided around the insulating layer 110. Another insulating layer 130 is provided around the semiconductor layer 120. A layer of yarn around the other insulating layer 130 forms a protecting layer 140. A protective layer 150 of a flame retardant material forms an outer layer of the cable 56. The ignition apparatus 10 also includes one or more of: a field stabilizer device 30 for stabilizing and regulating high tension voltage in the cable 56; resistor spark plugs 60; connectors fitted to ends of the cable 56 that include resistors therein, such as resistor spark plug boots.

8 Claims, 4 Drawing Sheets

U.S. PATENT DOCUMENTS

| | | | | | |
|---|---|---|---|---|---|
| 4,800,359 | A | | 1/1989 | Yukawa et al. | |
| 4,998,090 | A | * | 3/1991 | Park | 338/214 |
| 5,032,969 | A | * | 7/1991 | Eggers et al. | 363/21.11 |
| 5,034,719 | A | * | 7/1991 | Brown et al. | 338/66 |
| 5,057,812 | A | * | 10/1991 | Yukawa et al. | 338/66 |
| 5,059,938 | A | | 10/1991 | Brown | |
| 5,397,860 | A | | 3/1995 | Yochum et al. | |
| 5,531,199 | A | * | 7/1996 | Bryant et al. | 123/297 |
| 5,603,306 | A | | 2/1997 | Tai | |
| 5,824,958 | A | | 10/1998 | Higashikozono et al. | |
| 5,875,542 | A | * | 3/1999 | Tran et al. | 29/603.14 |
| 6,054,028 | A | | 4/2000 | Zingheim et al. | |
| 6,252,172 | B1 | * | 6/2001 | Tanigawa et al. | 174/102 SC |
| 6,763,816 | B1 | * | 7/2004 | Nakabayashi et al. | 123/634 |
| 7,282,639 | B2 | * | 10/2007 | Farmer | 174/36 |

FOREIGN PATENT DOCUMENTS

| | | |
|---|---|---|
| JP | 1038908 | 2/1989 |
| JP | 05074629 | 3/1993 |
| JP | 07045129 | 2/1995 |
| NL | 6715641 | 5/1986 |

* cited by examiner $n_1 = 1-5$
$n_2 = 1-5$
$n_3 = 1-3$

IGNITION APPARATUS

BACKGROUND TO THE INVENTION

This invention relates to ignition apparatus. More particularly, this invention relates to ignition apparatus for a spark-ignition internal combustion engine.

A spark-ignition internal combustion engine conventionally includes a number of spark plugs situated in a cylinder head of the engine for creating a spark in each cylinder thereof. Each spark plug is connected to a respective terminal of a distributor by a respective high tension ignition lead. The phrase "high tension", is used to differentiate electrical components that are used to conduct charge at comparatively high potential from those components that conduct large at comparatively low potential. In the case of a typical automobile engine, high tension components can have a potential difference thereacross measured in kV, such as 25 kV, whereas low tension components would be raised to a potential of tens of volts. In operation, the distributor connects a high voltage across each ignition lead, and hence the respective spark plug, rapidly in succession. This high voltage is sufficient to produce a discharge arc, that is to say a spark, across a respective air gap of each spark plug. During the short-lived existence of the spark, charge flows in an associated ignition lead. The nature of the spark is that high frequency current exists in the lead. This is sometimes referred to as "high frequency noise" and tends to result in radio frequency radiation being emitted by the ignition lead. This radiation is sometimes referred to as radio frequency interference (RFI) as it may interfere with nearby electrical apparatus and thus be problematic. For example, in the case of an automobile, such radiation may interfere with audio equipment of the automobile, such as an in-car Hi-Fi, and may also interfere with computer processing apparatus of the automobile, such as engine management computers.

In an attempt to address this problem, engine and automobile manufactures have sought to use ignition leads with a high electrical resistance. For example, it has been found that use of ignition leads with a resistance of 16 kΩ/m acts to suppress high frequency noise. A drawback of increasing the resistance of ignition cables, however, is that the intensity of the spark may be reduced, resulting in incomplete combustion which in turn leads to reduced power output and increased emissions from the engine. The heating of the ignition leads brought about by their high resistance may also shorten their useful life. There is therefore a trade-off between high frequency noise suppression on the one hand and engine performance and ignition lead life on the other. In attempt to strike the correct balance, at least some international standards limit the resistance of ignition leads to 16 kΩ/m. Thus, the tendency has been for manufacturers to favour leads of high resistance but which are within this limit, for example leads with a resistance of 16 kΩ/m. Such leads, however, still give rise to the drawbacks set out above.

It is an object of at least one embodiment of this invention to address this problem.

Currently-available ignition cables tend to be of one of three different types of construction. The first type includes a highly electrically conductive metal wire, such as copper, to form an electrically conductive core. The second type includes electrically insulating fibres, such as glass or aramid, that are coated with an electrically conductive compound to form the conductive core. The third type also includes electrically insulating fibres, but these are surrounded by a ferrite layer, with a conducting metal wire being wound helically around both the fibres and the ferrite layer to form a core. The wire can be of Ni—Cr alloy, Cu—Sn alloy or stainless steel.

However, each of these types of construction suffers from drawbacks. Drawbacks of the type of construction that uses a copper core include poor resistance to corrosion and poor high frequency noise suppression, together with the resulting cable being rigid and heavy. The second construction type that includes a core formed of insulating fibres coated in a conductor exhibits the undesirable characteristic of an increasing resistance with use. This leads to a worsening of the problems associated with high resistance as set out above. The ferrite layer of the third construction type has poor mechanical properties and is prone to cracking, especially under dynamically varying and tensile forces.

It is an object of at least one embodiment of this invention to address these problems associated with currently-available cables.

SUMMARY OF THE INVENTION

According to one aspect of this invention, there is provided a high tension ignition cable for a spark ignition internal combustion engine, the cable having a resistance per unit length of less that 10 kΩ/m, and a core formed at least partly from an electrically conducting material that includes fibres of a non-metallic conducting material.

According to another aspect of this invention, there is provided ignition apparatus for a spark-ignition internal combustion engine, the apparatus including high tension ignition cable having a resistance per unit length of less that 10 kΩ/m, the apparatus further including radio frequency interference suppression means that includes at least one of:

(a) a resistor spark plug, the cable being for connection to the spark plug;

(b) a connector attached to an end of the cable, the connector including a resistor therein;

(c) a field stabilizer device including electronic components arranged to stabilize and/or regulate high tension voltage in the cable;

(d) semiconductor material disposed in the cable, whereby the apparatus is arranged to suppress radio frequency interference caused by a changing current in the cable thereof.

The cable may have a resistance per unit length of less that 7 kΩ/m. It may have a resistance per unit length of less that 1 kΩ/m. It may have a resistance per unit length of less that 0.5 kΩ/m. More preferably, it has a resistance per unit length of less that 100 Ω/m. Most preferably, it has a resistance per unit length of less than 50 Ω/m.

It has been found that providing ignition apparatus that includes a cable of low resistance, such as less than 10 kΩ/m, has an effect on engine operation. This is particularly the case if the resistance per unit length of the cable is even lower, for example, less than 50 Ω/m. For example, the provision of such cable has been found to improve engine starting and idling, increase power output of the engine, improve fuel economy and reduce unburned hydrocarbon and toxic exhaust emissions, which in turn prolongs the life of any catalytic converter fitted to the engine. Improvements in combustion may also reduce carbon deposits deposited on spark plugs and hence prolong the useful life of sparkplugs.

The apparatus may include one, more or all of the features listed at (a) to (d), in any combination.

The connector that includes a resistor therein may be a connector for receiving a sparkplug, wherein the connector is a resistor spark plug boot. The resistor connector may be a connector for connector to a high tension electrical terminal, such as, for example, a terminal of a distributor or of a transformer coil.

The resistor spark plug and/or the connector that includes a resistor therein may include a resistor with a resistance of between 0.2 Ω and 16 k Ω. More preferably the resistor is in the range of 300 Ω to 9 kΩ. More preferably still, the resistor is in the range 500 Ω to 6 kΩ. Most preferably, the resistor is in the range 1 kΩ to 4 kΩ.

It has been found that providing the ignition apparatus with a resistor spark plug or a resistor boot that has a resistor with such a resistance suppresses radio frequency interference caused by a changing current in the cable to an acceptable level, resulting in the apparatus achieving both the improved engine operating characteristics attributable to the low resistance cable and acceptable suppression of radio frequency interference.

The field stabilizer device preferably includes a stabilizer and/or a regulator, the stabilizer being arranged to stabilize the voltage of the current through the device and the regulator being arranged to regulate the voltage of the current through the device. Preferably the device is arranged to deliver a current with a voltage that is sufficiently constant so as to have a beneficial effect on noise suppression and/or of a magnitude that gives rise to good spark characteristics. The field stabilizer device may be arranged just to receive high tension ignition current. The field stabilizer device is preferably connected on the side of the cable remote from the spark plugs. The field stabilizer device is preferably connected on the input side of the distributor. The field stabilizer device may be connected on either side of a transformer coil. The field stabilizer device may be additionally arranged to receive current from other electrical components, such as electrical components associated with an automobile or an internal combustion engine, such as, for example, fuel pumps, transmission components, throttle components, an alternator, and so on. The field stabilizer device may be arranged to receive leakage current. The leakage current may be from components such as those just listed or conceivable any component, including, for example the automobile chassis. The leakage current may be grounded and/or recycled back to the battery and/or ignition components such as the distributor. The field stabilizer device may include a radio frequency interference (RFI) suppressor. The field stabilizer device may also be arranged to monitor the current that it receives. The field stabilizer device may further include field booster means for use with a molecular stabilizer and/or fuel cracker that is or are arranged to act on a fuel line of the engine.

The cable may have a core formed at least partly of an electrically conducting material. The core may include fibres of a non-metallic conducting material, such as, for example, carbon or graphite. The core may consist of a plurality of elongate ones of the fibres, extending side-by-side. Preferably, the fibre material has a specific gravity in the range 1.2 to 2.0. The core may be of fibres derived from the carbonisation of man-made fibres, coal tar and/or petroleum pitch. The man-made fibres may include natural polymers and their derivatives, such as cellulose and rayon. The man-made fibres may include synthetic polymers such homopolymers and/or copolymers of polyacrylonitrile. The man-made fibres may be oxidised in air at a temperature of 200 C to 300 C. The man-made fibres may be converted into an infusible form by chemical crosslinks at a temperature up to 300 C. The man-made fibres may be carbonised at a temperature of 1000 C to thereby convert the fibres into graphite; and, optionally, subsequently heat treated at a temperature in the range of 1500 C to 3000 C to form carbon or graphite fibre filaments. Preferably, the fibres have a polycrystalline structure orientated with graphite planes aligned in parallel to the fibre axis. Preferably the fibres have a tensile strength in the range of 100,000 to 900,000 lbs/sq in. Preferably, the fibres have good fatigue and/or damping characteristics, and preferably have high corrosion resistance and/or chemical inertness.

The core may be at least partly formed by supporting a substrate, to which carbon fibre is attached, about a support member. The substrate may in the form of an elongate strip of material such as a tape. The substrate may be impregnated with the carbon fibre. The tape may be of a polymeric material. The arrangement may be similar in construction to a conventional fibre-reinforced tape. The tape may be wrapped around the support. The substrate may be a fabric and may be woven or non-woven.

The core may be formed by extrusion.

The core may include a plurality of the fibres suspended in a substrate. The substrate may be a thermoplastic. The substrate may be polymeric. The core may be of a carbon fibre reinforced polymeric composite, in which the carbon fibre is preferably in the form of filaments or in the form of cut lengths of the fibre. Less preferably, the core includes carbon fibre in powder form. The polymeric material may be, for example, epoxy or a thermoplastic such as polyamide, polycarbonate, thermoplastic polyurethane, polyphenylene sulphide or polybutylene terephthalate.

The core may further include metal particles suspended in the substrate. The addition of metal particles can be used to increase conductivity, thereby reducing resistance.

Forming the core with conducting elements in the form of non-metallic conductive fibre, whether these be a plurality of elongate fibres arranged substantially in parallel, or fibres suspended in substrate, or fibres in some other form, successfully addresses at least some of the problems associated with currently-available leads. For example, non-metallic conductive fibres can be more resistant to corrosion than, for example, copper; and can exhibit a more constant resistance over time than non-conductive fibres coated with a conductive material. Non-metallic conductive fibres are also less prone to cracking that is, for example, ferrite material.

The semiconductor material may be disposed around the core. The semiconductor material may form a layer, such as a coating, on and around the core. The semiconductor material may be disposed in the core. The core may be impregnated with the semiconductor material. Preferably the semiconductor material is flexible so that it is resistant to cracking or breaking when the cable is bent as it may be during use. The semiconductor material may be plastically deformable. The semiconductor material may be elastically deformable. The semiconductor material may include polymeric compositions, such as, for example: acrylate bases and their copolymers, thermoplastics such as PE and/or EVA, thermosets such as crosslinkable polyolefin, ethylene-vinyl acrylate copolymer, ethylene-propylene copolymer, ethylene-propylene-diene terpolymer, ethylene-vinyl acetate copolymer, epichlorohydrin homopolymer and/or copolymer, nitrile rubber, hydrogenated nitrile rubber, acrylic rubber and silicone rubber. The semi-conductor material is preferably based on thermosets like crosslinkable polyolefin, ethylene-vinyl acetate copolymer, ethylene-vinyl acrylate copolymer, epichlrorhydrin polymers and silicone rubber. A flexible semi-conductor material with good mechanical properties, that is resistant to bending and heat ageing, and that has low volume resistivity, is preferred. For these reasons, a semi-conductor material based on acrylate type and epichlorohydrin type polymers is preferred. The semi-conductor material may include a conductive filler material, such as, for example, conductive carbon black, graphite and/or conductive metal, which may be in the form of a powder. Preferably the conductive filler material is in the range of 20 PHR to 200 PHR. PHR refers to the weight of the conductive filler relative to 100 parts weight of the polymer. Selection of the polymer base material, together with the amount of conductive filler therein, can be chosen to give a semi-conductor material with a preferred conductivity.

The semiconductor layer may be formed by extrusion. It may be formed by impregnation.

The cable may include no semiconductor material.

The electric resistivity at 15 C of the layer of semiconductor material may be in the range of 100 Ω/m to 1000MΩ/m.

The cable may include insulating material therein or thereon. The insulating material may form one more insulating layer of the cable. Preferably, the cable includes an insulating layer on and around the core. Preferably, the cable includes an insulating layer disposed between the core and the semiconductor material, which may form another layer on and around the insulating layer. The cable may also or alternatively include an insulating layer on and around the semiconductor material. The insulating material may be a polymeric material and may include, for example: thermoplastics, such as polyvinyls, polyolefin bases, polyamide and polyester; thermoplastic elastomers; and preferably themosets, such as crosslinkable polyolefin, ethylene-propylene copolymer, ethylene-propylene-diene terpolymer, chlorinated polyethylene, chloroprene rubber, chlorosulfonated polyethylene and silicone rubber.

The or each insulating layer may be formed by extrusion.

The cable may include protecting material to protect other components of the cable from damage. The protecting material may be formed around one or more of the other components of the cable to form a protecting layer. The protecting material may form an outermost layer of the cable. The protecting material may include one or more yarns of fibre that is or are spiralled, or preferably braided, around other components of the cable to form the protecting layer. The protecting material may include glass fibre and/or man-made fibre yarn such as, for example, polyester, polyamide, polyaramid, cellulose and viscous rayon. The protecting layer may include fibre-reinforced tape that is wrapped around other components of the cable to form the protecting layer. The protecting layer increases the strength of the cable and protects other layers thereof. This increase in strength can be useful during manufacturing of the cable when a high strength is necessary if connectors are to be press-fitted to ends of the cable.

The protecting layer may be reinforced with a reinforcing material. The reinforcing material may include glass fibre and/or steel wire. The reinforcing material may form a layer on and around the protecting layer.

The cable may include an outermost layer. The outermost layer is preferably flame retarding and is formed of a flame retardant material. Preferably the outermost layer is formed of a material that has good dielectric properties. For example, the outermost layer may be formed of a material that exhibits volume resistance at 20 C of at least $10^{13}$ Ohm/cm. Preferably the outer most layer is formed of a material that is resistant to one or more of: oil, fuel, abrasion and ozone. Preferably the flame retardant material exhibits heat resistance in the range of 125 C to 200 C. The outermost flame retardant layer are based on ethylene-vinylacetate co-poloymer, crosslinkable polyolefin, ethylene-vinyl acrylate copolymer, ethylene-propylene copolymer, ethylene-propylene-diene terpolymer, hydrogenated nitrile, silicone rubber, chloroprene rubber, chlorinated polyethylene, and chlorosulfonated polyethylene. The outermost flame retardant layer is preferably at least partly formed of zero-halogen low-smoke non-corrosive polymeric materials.

Preferably, each component of the cable is of a material that does not contain halogens and that preferably is flame retardant. This has the result of the cable tending not to emit hazardous toxic and corrosive gases during a fire.

The cable may be for connecting between a distributor and a spark plug. The cable may be for connecting between a transformer and a distributor. The cable may be for connecting between any two terminals for the purposes of conducting charge at a high potential.

It is envisaged that the cable and/or the ignition apparatus may be for use with any type of engine in which it is desired that RFI caused by ignition be minimised. For example, the cable and/or the ignition apparatus may be used with carburettor-based or fuel injected engines, with gasoline or LPG engines, or with automobile, motorcycle or industrial engines.

According to a further aspect of this invention, there is provided a field stabilizer device as defined hereinabove.

BRIEF DESCRIPTION OF THE DRAWINGS

Specific embodiments of the invention will now be described by way of example only and with reference to the accompanying drawings, in which.

DETAILED DESCRIPTION OF EMBODIMENTS OF THE INVENTION

Figure 1:
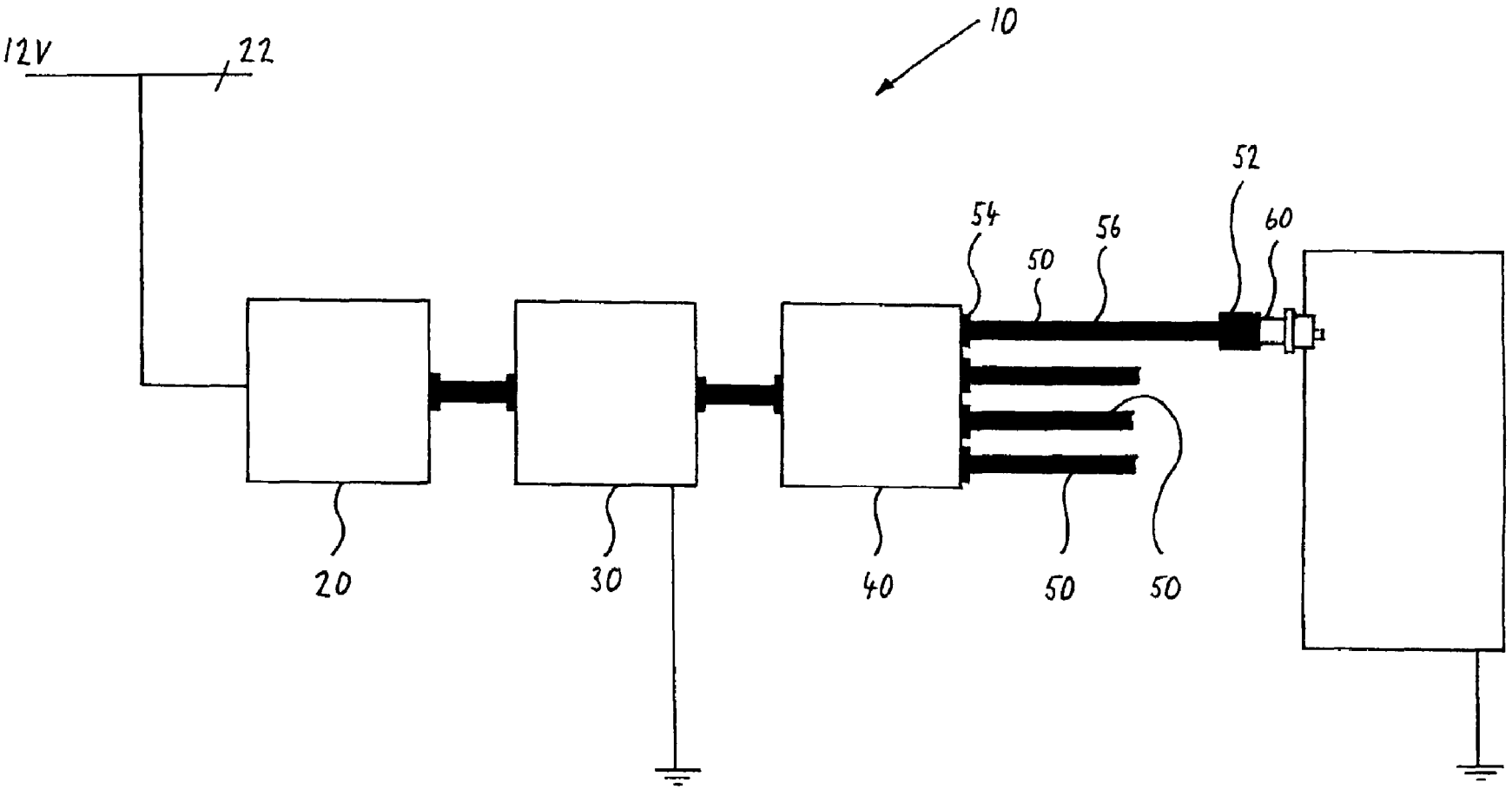
FIG. 1 is a schematic view of a ignition apparatus that embodies this invention.

FIG. 1 shows ignition apparatus 10 that is a first embodiment of this invention. The ignition apparatus 10 is for use with a spark-ignition internal combustion engine, such as that of a conventional automobile (not shown). There are several components that go to make up the ignition apparatus 10. These are a transformer coil 20, a field stabilizer device 30, a distributor 40, high tension ignition leads 50 and spark plugs, only one 60 of which is shown. The general arrangement and interconnection of these components will firstly be described, and then certain of the components will be described in turn in more detail.

In general, the ignition apparatus 10 is arranged with an input of the transformer coil 20 connected to a 12V DC supply of electricity from a low tension electrical circuit 22. The transformer coil 20 is conventional. A high tension output of the transformer coil 20 is connected to an input of the field stabilizer device 30. The field stabilizer device 30 is not conventional and at least in part embodies the present invention. A high tension output of the field stabilizer device 30 is connected to an input of the distributor 40. The distributor 40 is conventional. The Four high tension ignition leads 50 that at least partly embody the invention are each connected to a respective output of the distributor 40, it being envisaged in this embodiment that the apparatus 10 is for use with a typical automotive engine. Each lead 50 terminates in a connector 52, 54 at each of its ends. The connector 54 that is adjacent the distributor is conventional and is for plugging into an output terminal thereof. The other connector 52 is a spark plug-receiving boot 52. For simplicity of illustration, only one boot 52 is shown. A respective spark plug is received in each boot 52. Again, for simplicity, a single plug 60 is shown received in the boot 52.

As mentioned above, the coil 20 and distributor 40 are conventional. These will therefore not be described in further detail. The remaining components are however now described in more detail.

Figure 2:
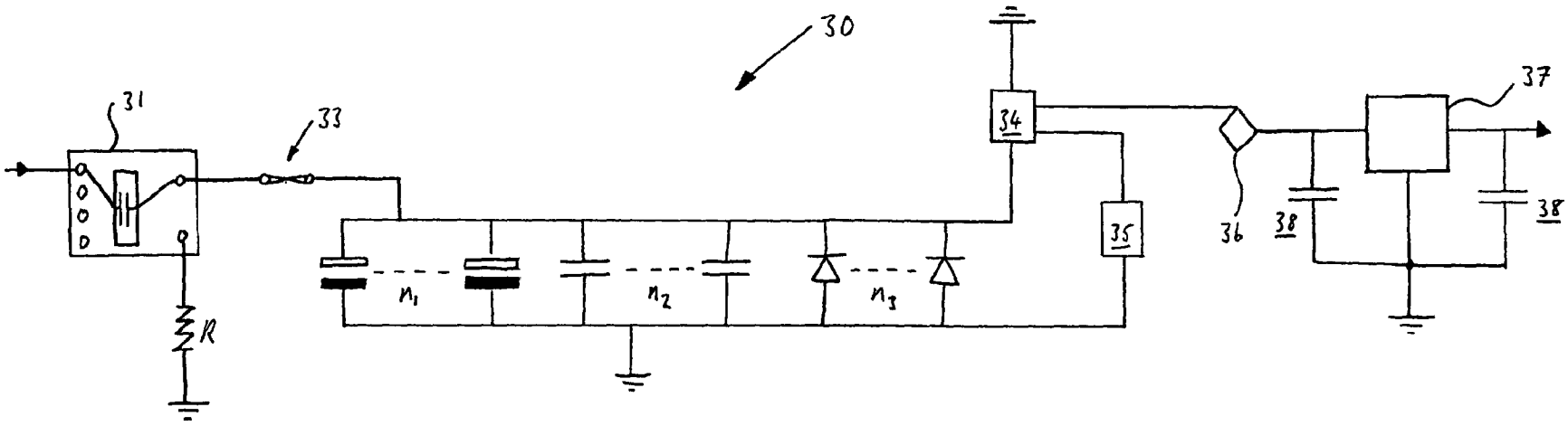
FIG. 2 is a schematic circuit diagram of components of an exemplary field stabilizer device of the apparatus.

The field stabilizer device 30 is shown in more detail in FIG. 2. With continued reference to FIG. 2, it can be seen that the field stabilizer device includes input connector block 31 at an input end of the device 30. The input connector block 31 is arranged to receive a number of electrical connections from electrical components associated with the engine of the automobile or other electrical systems of the automobile. For example, connection may be made to electrical driveline components, fuel line components, an alternator, an ignition coil, the distributor and combustion chamber. In this embodiment, at least one of these connections is to a high tension cable from the transformer coil 20. Inputs to the connector block 31 are connected to one terminal of a capacitor, with the other terminal being connected to an output of the connector block. The connector block 31 is connected to ground across a resistor R which has a high resistance of the order of kΩ. An output of the connector block 31 is fed through a fuse 33 that acts as a safety cut out. The fuse 33 is a 12V, 30 A, Blade-type fuse. The device 30 then includes a number of capacitors and diodes connected in parallel between the terminal of the fuse that is remote from the connector block 31 and a ground connection. The capacitors and diodes are arranged in a manner that would be understood by a person skilled in this art to create a stabilizer arranged to stabilize the voltage of the current through the device 30. Specifically, the device 30 includes n1 Electrolytic-type capacitors, n2 Mica-type capacitors, and n3 diodes connected in parallel. In this particular embodiment, n1 is in the range 1 to 5, and preferably is in the range 2 to 4; n2 is in the range 1 to 5, and preferably is in the range 1 to 3; and n3 is in the range 1 to 3, and preferably is in the range 1 to 2. The Electrolytic-type capacitors are for low to mid frequency response, the Mica-type capacitors are for high frequency response, and the diodes are for reverse damping protection. It is envisaged that in alternative embodiments, one or more Polyester-type capacitors may be used in substitution for one or more of the mica-type capacitors. Such Polyester-type capacitors would be used for mid frequency response. A micro-controller 34 is also provided downstream of the capacitors and diodes and is connected across the live and ground terminals of those components. The micro-controller is arranged to control and adjust current flow through the device 30. The ground terminals of the capacitors and diodes are however connected to the micro-controller 34 via a resistor 35. The resistor 35 is of high resistance for safe discharge following disconnection of the device 30. An output of the micro-controller 34 is fed through a rectifier 36 to dwi coupling capacitors 38 and voltage regulator 37, which preferably includes a heat sink (not shown). An output of the voltage regulator 37 amounts to the output of the device 30. In this embodiment, the output of the device 30 is connected to an input of the distributor 40. In this embodiment, the device 30 is grounded such that leakage current from the electrical components or electrical systems referred to above is grounded. In an alternative With the circuit design shown in FIG. 2 and described hereinabove, the field stabilizer device 30 can stabilize and regulate the incoming voltage supply, monitor and regulate to a preferred magnitude the direct current to the distributor for ignition sparking purpose.

As stated above, in this embodiment, at least one of the inputs to the device 30 is the high tension cable running from the high tension output of the transformer coil 20. However, it an alternative embodiment, the device 30 may be positioned upstream of the coil 20 so as to receive a low tension supply of electricity, with the output of the device 30 being connected to the input of the coil 20. The device 30 may also be used in embodiments wherein the distributor includes a transformer coil therein, such as can be the case with modern multi-injection ignition systems. In such an embodiment, the device would be position upstream of the distributor.

In this embodiment, each of the high tension ignition leads 50 is the same as each other lead 50. Only one of the leads 50 will therefore be described in detail. The representative lead 50 includes a length of cable 56 running between the connector 54 that is for plugging into the distributor 40 and the spark plug-receiving boot 52. The composition of the cable is shown in FIG. 3.

Figure 3:
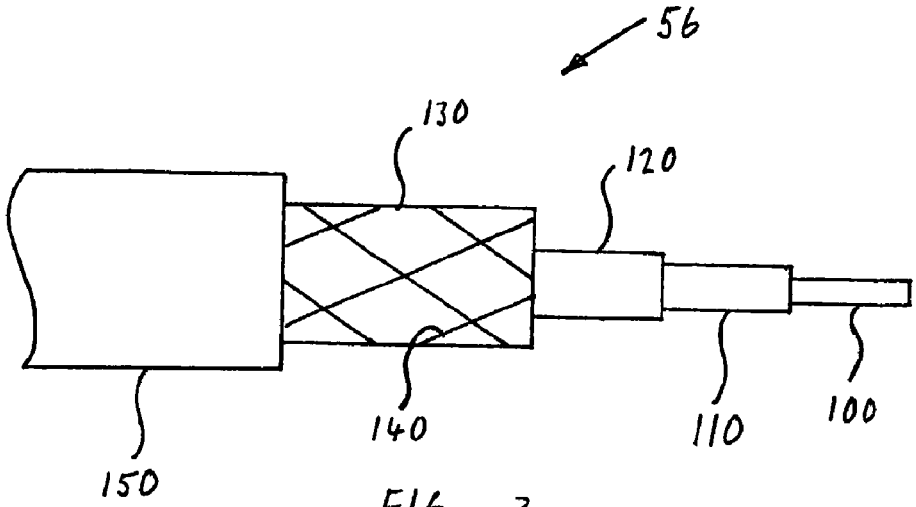
FIG. 3 is diagrammatic view showing the composition of a first exemplary cable of the ignition apparatus.

With continued reference to FIG. 3, the cable 56 is made up from a number of co-axial layers. An innermost one of the layers is an electrically conductive core 100 of the cable 56. The core 100 is formed from a large number of elongate carbon fibre filaments arranged in a bundle, side-by-side. The core 100 is arranged so as to have low electrical resistance per unit length. In this embodiment, the core 100 have a resistance of less that 50 Ω/m. The core 100 include fibres derived from the carbonisation of man-made fibres, preferably synthetic fibres based on polyacrylonitrile and its derivatives. The next innermost layer is a first insulating layer 110. The first insulating layer 110 is radially juxtaposed with the core 100 so as to contact and surround the core 100. The first insulating layer 110 is formed from a polymeric compound that has good insulating properties. Any one of the following materials may be used for this layer: crosslinkable polyolefin, ethylene-propylene copolymer, ethylene-propylene-diene terpolymer, chlorinated polyethylene and silicone rubber. A semiconductor layer 120 is formed around and on the first insulating layer 110. The material of the semiconductor layer 120 is chosen such that it is well adapted to damping and dissipating high frequency electrical energy. In this embodiment, the semi-conductor layer is formed from epichlrorhydrin polymers. Epichlorohydrin polymers are comparatively easy to process and form a flexible semi-conductor layer with good mechanical properties, and resistance to bending and heat ageing. They can also be used to form a semi-conductor layer with a low resistivity per unit length of, for example, 1 kΩ/m. This makes them suitable for a semi-conductor layer that is to be placed around the outside of the core 100. A second insulating layer 130 is provided around and on the semiconductor layer 120. The composition of the second insulating layer 130 is intended to be the same as that in the first insulating layer 110. The second insulating layer is surrounded by a layer of yarn that is spiralled or preferably braided so as to form a reinforcing layer 140. A yarn of high mechanical strength is chosen in order to increase the tensile strength of the cable 56 and its resistance to bending and compression forces. In this embodiment, polyester is used as the material for the yarn. However, polyamide and/or glass fibre may also be used. The outermost layer of the cable 56 is a protective layer 150. The protective layer is formed of a material that is well suited to withstanding the corrosive substances found in an engine compartment of an automobile as well as high engine compartment temperatures. In this embodiment, the protective layer 150 is formed from a flame retardant material that is also resistant to corrosion or degradation as a result of oil, fuel, ozone and mechanical working, which, in this embodiment is silicone rubber.

As stated above, the one one 52 of the connectors 52, 54 that is for connecting to the spark plug 60 is termed a "boot". In this embodiment, the boots 52 are conventional. It is, however, envisaged that an unconventional form of boots termed "resistor boots" may be used. Resistor boots are similar to conventional boots but include a series-mounted electrical resistor inside the boot arranged such that electrical charge passing from the ignition cable to a spark plug received in the boot must pass through the resistor.

In this embodiment, the spark plugs 60 that are used in the ignition apparatus 10 are an unconventional form of spark plug known as "resistor spark plugs". Resistor spark plugs are similar to conventional spark plugs but additionally include a series-mounted resistor therein to provide the plug with an internal resistance. In the present invention, the resistor spark plugs 60 are selected each with a resistance of about 1 KΩ. It is envisaged, however, that resistor plugs with other resistances may be selected.

In operation, the distributor 40 periodically connects a high potential difference across the cable 56 in the conventional manner. As will be appreciated, this causes a spark at the spark plug 60, with charge then flowing in the conductor core 100 of the cable 56. As the conductor core is of low resistance per unit length—less than 50 Ω/m in this embodiment—a good strong spark is produced. This minimises the risk of poor or incomplete combustion of the fuel-air mixture in which the spark is created.

The use of resistor spark plugs 60, although increasing the overall resistance of the cable, boot and spark plug arrangement and so, at least to some extent, will weaken the spark, tends to prolong the duration of the spark and so acts to reduce the high frequency noise resulting therefrom.

High frequency noise that does result from the sparking will be in the form of a high frequency current in the cable 56. As a result of the so-called "skin effect", this high frequency current will tend to exist in the radially outermost conductive part of the cable 56. This part is the semiconductor layer 120. The semiconductor layer is chosen and arranged so as to effectively suppress high frequency currents therein. Thus, the high frequency noise is further suppressed.

Figure 4:
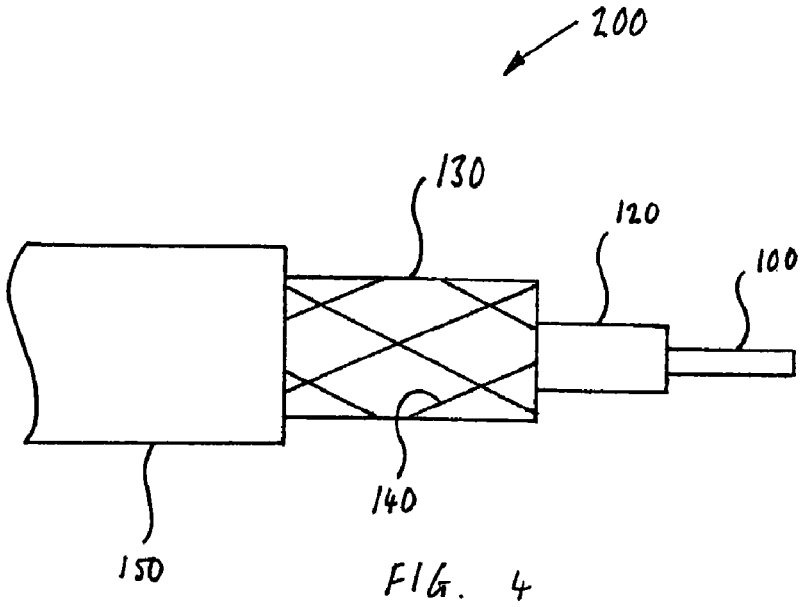
FIG. 4 is a diagrammatic view showing the composition of a second exemplary cable.

FIG. 4 shows a second embodiment of this invention in which a first alternative cable 200 is provided. The first alternative cable is the same as the cable 56 described above with reference to FIG. 3, but lacks the first insulating layer 110 thereof. All the other layers of the cable 56 described with reference to FIG. 3 are, however, present in the first alternative cable 200. Thus, the cable 200 includes the electrically conductive core 100, the semiconductor layer 120, the insulating layer 130 that surrounds the semiconductor layer 120, the reinforcing layer 140 and the protective layer 150.

Figure 5:
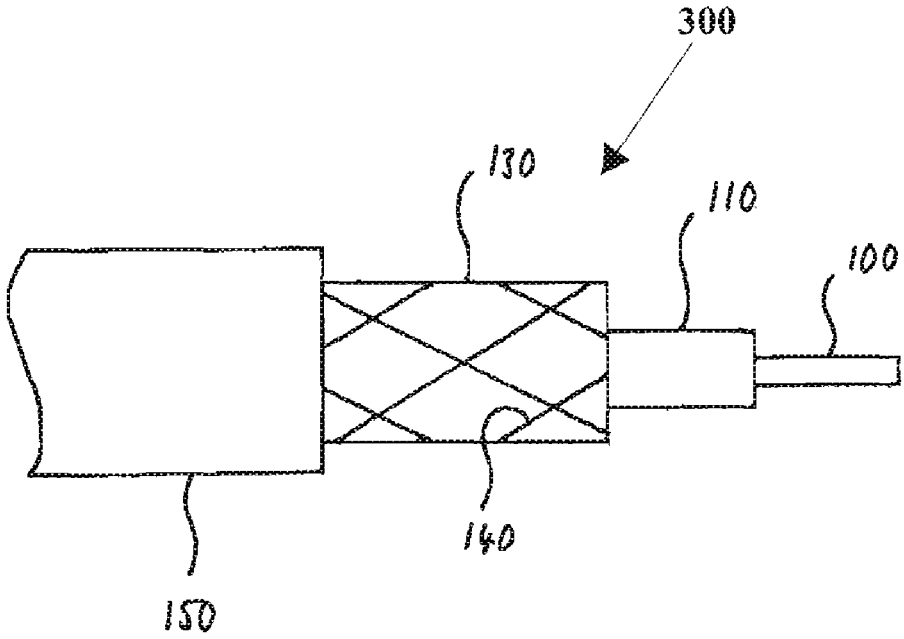
FIG. 5 is a diagrammatic view showing the composition of a third exemplary cable.

FIG. 5 shows a third embodiment in which a second alternative cable 300 is provided. The second alternative cable 300 is similar to the cable 56 described above with reference to FIG. 3, but differs in lacking the semiconductor layer 120. All the other layers are, however, present.

From the forgoing description, it should be understood that the various component parts of the ignition apparatus described above may be used with great flexibility and the beneficial result of a low-resistance cable with acceptable high-frequency noise suppression still obtained. It should also be understood that one or more of those component parts of the apparatus may be omitted and the apparatus still used to advantageous effect. For example, although it is envisaged that the field stabilizing device could be used additionally to suppress high frequency noise, this component may be omitted and the remaining components selected and arranged such that acceptable high frequency noise suppression is still obtained. Similarly, resistor spark plugs and/or resistor boots may be used, and their respective resistances selected, such that, in combination with the cable, acceptable high frequency noise suppression is obtained. Furthermore, it is envisaged that no resistor spark plugs or resistor boots may be used and, instead, the field stabilizer device be employed to ensure acceptable high frequency noise suppression. Another option would be to use neither resistor spark plugs, resistor boots, nor the field stabilizer device and instead rely upon semiconductor material in the cable to suppress high frequency noise. Other combinations of the components described herein are envisaged and will present themselves to the skilled reader in the light of the foregoing description.

In alternative cables that also embody the present invention, a carbon fibre-filled thermoplastic composite may be substituted for the carbon fibre core 100 in any of the embodiments described above. In the carbon fibre-filled thermoplastic composite, the carbon fibre is in the form of short filaments and/or cut lengths suspended in thermoplastic material.

In other alternative cables that embody the present invention, the reinforcing layer 140 may be omitted from any of the embodiments described above if the outermost protective layer 150 were arranged so as to have acceptable resistance to mechanical actions such as cutting, tearing, abrasion and compression.

The invention claimed is:

1. A high tension ignition cable for a spark-ignition internal combustion engine, the cable having a resistance per unit length of less than 7 kΩ/m, and comprising:

a conductor care formed at least partly with a non-metallic conducting material in a form of a plurality of elongated fibres of carbon fibre or graphite fibre;

a semi-conducting layer formed by semiconductor material and having a resistivity that is in a range of 100 Ω·m to 1000 M Ω·m, the semi-conducting layer being disposed substantially around the outside of the conductor core and being configured to damp and dissipate high frequency electrical energy in the cable without changing a resistance of the conductor core, the semiconductor material being flexible;

an insulating layer formed by insulating material and disposed around the outside of the semi-conducting layer, a protecting layer disposed outside the insulating layer, the protecting layer being formed by protecting material to protect other components of the cable from damage; and an outermost layer disposed at the outmost of the cable for protecting the cable against corrosion or degradation, the outmost layer being formed of a halogen free flame retardant material.

2. The cable according to claim 1, wherein the cable has a resistance per unit length of less than 7 kΩ/m, preferably less than 1 kΩ/m, more preferably less tan 110 Ω/m, and more preferably less than 50 Ω/m.

3. The cable according to claim 1, wherein the plurality of elongated fibres of carbon fibre are suspended in a substrate in a form of a carbon fibre-reinforced polymeric composite.

4. The cable according to claim 1, wherein the plurality of elongated fibres of the conductor core are derived from fibres selected from the group consisting of carbonisation of man-made fibres, coal tar and petroleum pitch.

5. The cable according to claim 1 wherein the plurality of elongated fibres of carbon fibre are suspended in a substrate in a form of an elongated strip of carbon fibre-reinforced tape.

6. The cable according to claim 1, wherein the resistivity of the semiconductor material is in the range of 100 Ω·m to 1000 MΩ·m.

7. The cable according to claim 1, wherein the plurality of elongated fibres extend side-by-side in a form of a bundle.

8. The cable according to claim 1, wherein the plurality of elongated fibres of carbon fibre are suspended in a substrate in a form of carbon fibre-reinforced thermoplastic composite.

* * * * *

UNITED STATES PATENT AND TRADEMARK OFFICE

CERTIFICATE OF CORRECTION

PATENT NO. : 7,665,451 B2
APPLICATION NO. : 11/568297
DATED : February 23, 2010
INVENTOR(S) : Lam It is certified that error appears in the above-identified patent and that said Letters Patent is hereby corrected as shown below:

Column 9, line 3: "the one one 52" should read --the one 52--.
Claim 1 Column 10, line 33: "a conductor care" should read --a conductor core--.
Claim 1 Column 10, line 56: "preferably less tan 110" should read --preferably less than 100--.

Signed and Sealed this

Eleventh Day of May, 2010

David J. Kappos

David J. Kappos
*Director of the United States Patent and Trademark Office*